United States Patent [19]

Cartwright et al.

[11] Patent Number: 4,578,876

[45] Date of Patent: Apr. 1, 1986

[54] PROCESS AND APPARATUS FOR SPRAYING A POWDER WITH LIQUID

[75] Inventors: William J. Cartwright, Hartley Wintney; Christopher W. Lyne, Fleet, both of England

[73] Assignee: Babcock Spraymixer Limited, Sussex, England

[21] Appl. No.: 679,545

[22] PCT Filed: Apr. 4, 1984

[86] PCT No.: PCT/GB84/00116

§ 371 Date: Dec. 7, 1984

§ 102(e) Date: Dec. 7, 1984

[87] PCT Pub. No.: WO84/04054

PCT Pub. Date: Oct. 25, 1984

[30] Foreign Application Priority Data

Apr. 8, 1983 [GB] United Kingdom ..... 8309673
Dec. 23, 1983 [CH] Switzerland ..... 6908/83

[51] Int. Cl.[4] ..... F26B 3/00; F26B 3/08; F26B 17/00

[52] U.S. Cl. ..... 34/9; 34/10; 34/57 C

[58] Field of Search ..... 34/9, 10, 57 C

[56] References Cited

U.S. PATENT DOCUMENTS

| | | | |
|---|---|---|---|
| 321,512 | 7/1885 | Mathewson | 34/10 |
| 2,413,420 | 12/1946 | Stephanoff | 34/10 |
| 2,837,467 | 6/1958 | McClure | 34/10 |
| 3,042,526 | 7/1962 | Spiess, Jr. et al. | 34/10 |

*Primary Examiner*—John J. Camby
*Attorney, Agent, or Firm*—Kemon & Estabrook

[57] ABSTRACT

The process includes entraining a powder having an average particle size in the range of 1 micron to 1.0 mm in air within a mixing vessel and spraying the entrained powder with a liquid within a spray zone in the mixing vessel. The process is used especially for a throughput rate in the range of 20 to 100 kg/hour of powder. The apparatus for carrying out the process includes a mixing vessel (2) accommodating an axially aligned venturi device (22) and a spray nozzle (18). The mixing vessel (2) may be connected to a vibratory fluidized bed chamber (28) for collecting the sprayed powder.

17 Claims, 3 Drawing Figures

PROCESS AND APPARATUS FOR SPRAYING A POWDER WITH LIQUID

Figure 1:
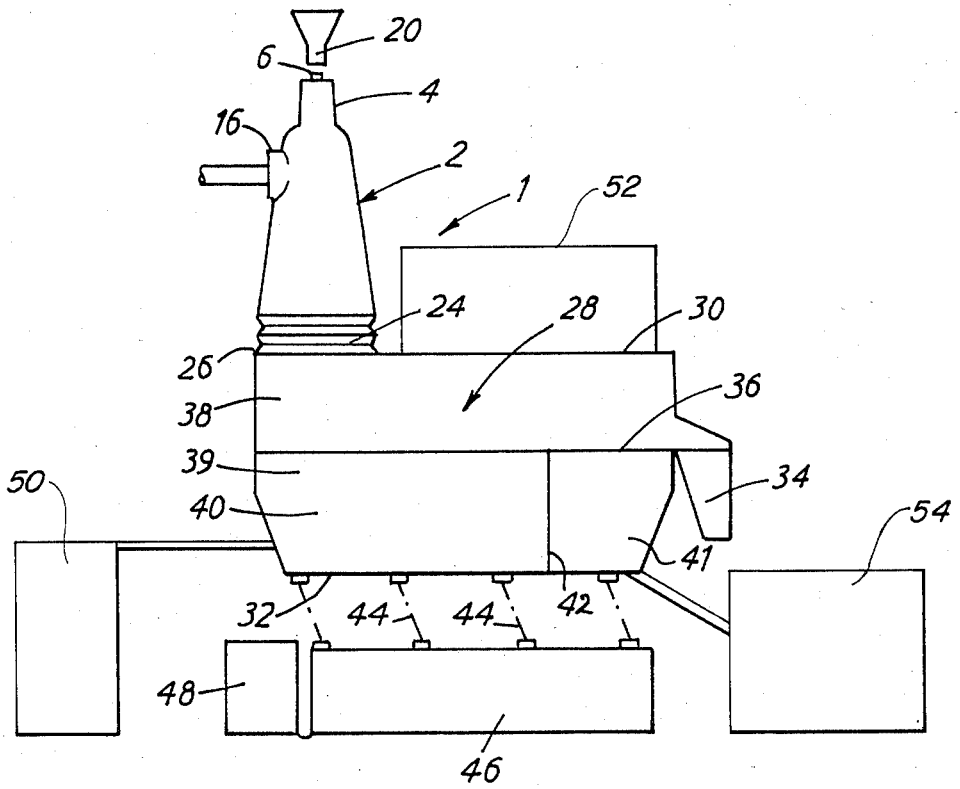

This invention relates to a process and an apparatus for spraying a powder with liquid and more especially to spraying a powder with liquid in a mixing vessel.

Previously an apparatus for spraying a powder with liquid has included a mixing vessel having an inlet duct in an upper portion, a spray zone portion including radially arranged spraying nozzles for producing a spray of liquid droplets and an outlet duct in a lower portion, together with a feeding means and a collecting means. In operation powder is entrained in air and conveyed by the feeding means into the inlet duct of the mixing vessel at an optimum throughput rate in the range of 100 to 20,000 kg/hour of powder, then the powder entrained in air is sprayed with liquid droplets emanating from the spray nozzles in the spray zone after which the sprayed powder is collected in the collecting means. To accommodate the powder entrained in air necessitates that the feeding means includes relatively larger diameter ducting and piping because of the velocity of the entraining air. Additionally the dimensions of the mixing vessel need to be correspondingly large so as to accommodate a relatively large volume of air having a high velocity to promote mixing of the powder entrained in air with the liquid droplets, and to provide a reduction in the velocity of the entraining air. Also the collecting means needs to be correspondingly large in dimensions so as to effect separation of the sprayed powder and the entraining air. Consequently such an apparatus is relatively large in overall dimensions thus having a relatively high capital cost. Additionally it is uneconomic to operate the apparatus at rates outside the optimum throughput rate, for example when a relatively small through rate of 50 kg/hour of powder is required.

It has now been found possible to provide a technically simpler apparatus which is structurally more compact and has relatively smaller overall dimensions. Thus having a relatively lower capital cost. Additionally the apparatus has been found to be economic to operate for throughput rates in the range of 20 to 100 kg/hour of powder.

According to the invention there is provided a process for spraying a powder with liquid including the steps of introducing a powder having an average particle size in the range of 1 micron to 1.0 mm as a stream into an upper region of a mixing vessel, effecting within the mixing vessel entrainment of the powder stream in air, spraying the powder entrained in air with liquid in a spray zone of the mixing vessel, and collecting the sprayed powder. According to the invention there is also provided an apparatus for spraying a powder with a liquid including a mixing vessel having aligned axially an upper portion including an inlet duct, a lower portion including an outlet duct, and a spray zone intermediate the upper and lower portions, a feeding means for feeding powder into the inlet duct of the mixing vessel having an outlet duct axially aligned with the inlet duct and the spray zone of the mixing vessel, a venturi device axially aligned within the upper portion of the mixing vessel intermediate the inlet duct and the spray zone arranged to effect entrainment of the powder in a stream of air, and a spray nozzle axially aligned within the spray zone arranged to direct a spray of liquid into the stream of air and entrained powder.

Figure 2:
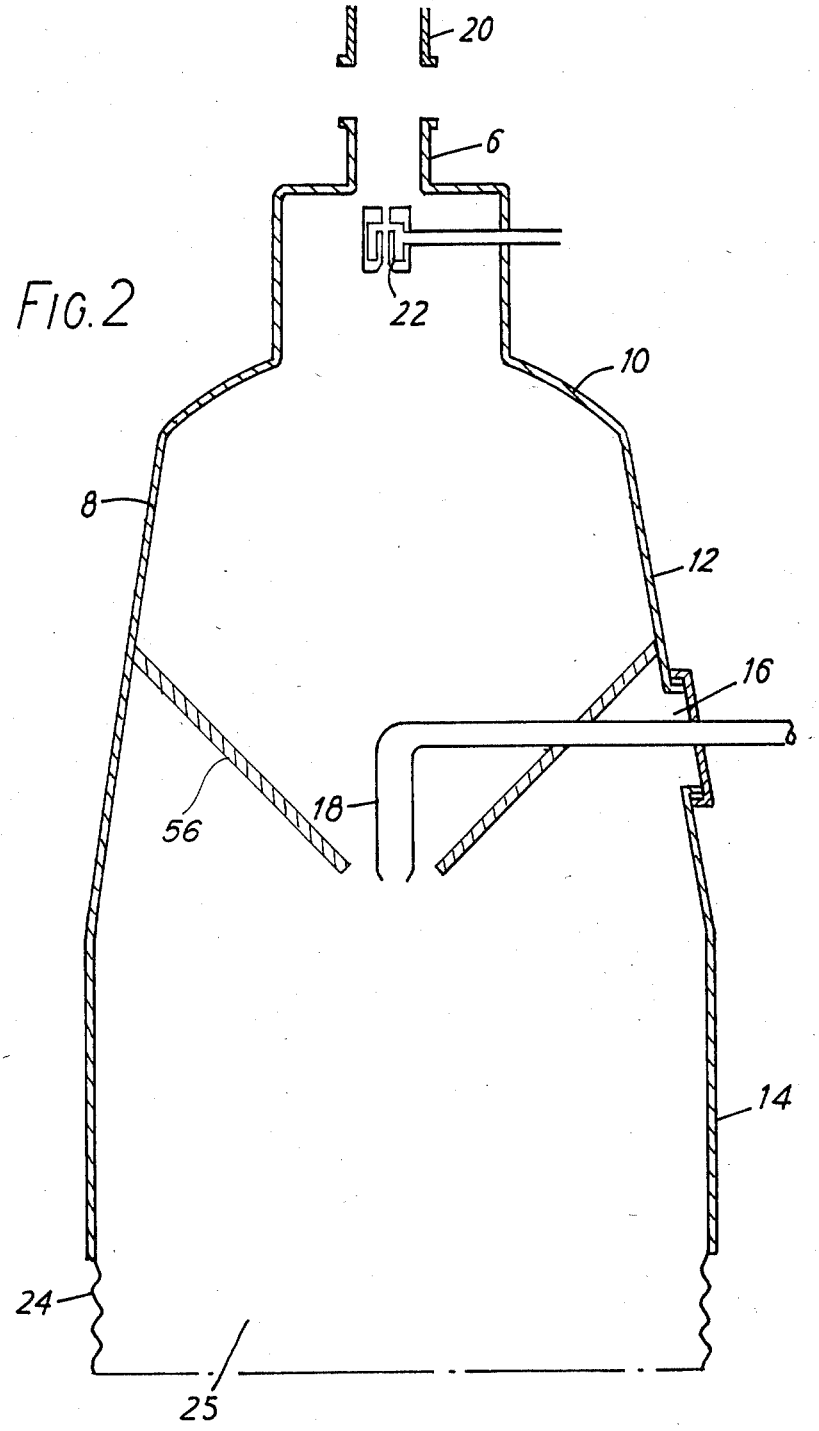
Figure 3:
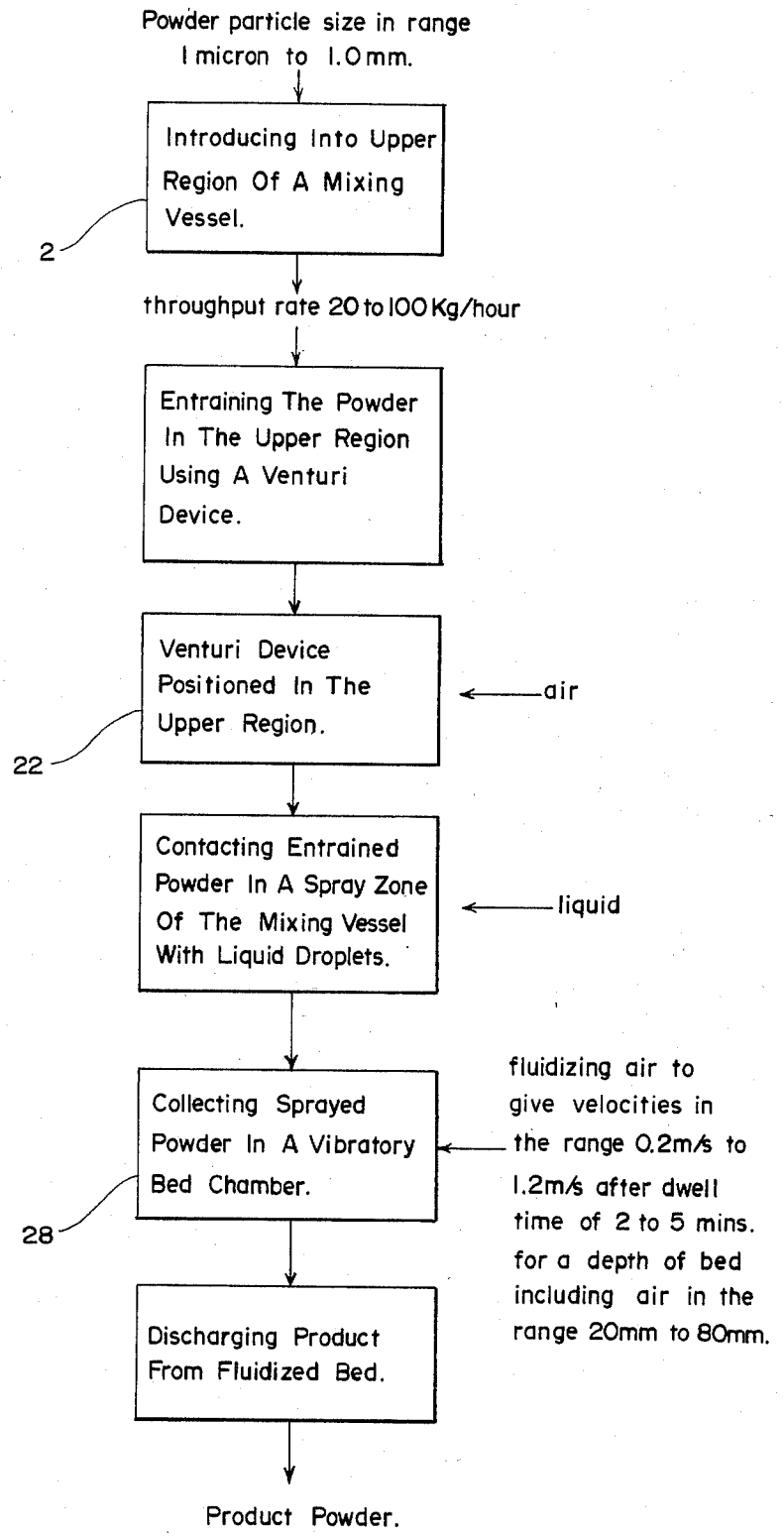

Embodiments of the invention will now be described, by way of example, with reference to the accompanying diagramatic drawings in which:

FIG. 1 represents an apparatus for spraying a powder with liquid including a mixing vessel mounted on a vibrating fluidized bed chamber; and FIG. 2 represents in section the mixing vessel represented in FIG. 1.

With reference to FIGS. 1 and 2 an apparatus 1 for spraying a powder with liquid includes a mixing vessel 2 having extending coaxially a cylindrical upper portion 4 having an axially aligned inlet duct 6, an intermediate portion 8 including an apertured domed upper region 10 and a downwardly diverging frusto conical region 12, and a cylindrical lower portion 14. The frustro conical region 12 includes a sealable port 16 through which passes an axially aligned nozzle 18 which extends downwardly into a spray zone enclosed by the frusto conical region 12. The nozzle is supplied with liquid from an external storage tank (not shown) to produce a downwardly directed spray of liquid droplets. Superjacent the inlet duct 6 and axially aligned therewith is an outlet duct 20 of a screw feeder which directs a downwardly flowing stream of powder into the mixing vessel 2. Positioned axially beneath the outlet duct 20 of the screw feeder and axially accommodated within the upper cylindrical portion 4 of the mixing vessel 2 is a venturi device 22 having a circumferentially extending chamber (not shown) discharging through a gap (not shown) extending circumferentially of a throat (not shown) of the venturi device 22. The chamber (not shown) is supplied with compressed air which produces by an induced venturi action on discharge through the gap (not shown) an acceleration in the flow rate of the powder stream and atmospheric air drawn into a mouth of the venturi device 22, and a spreading of the powder stream into a downwardly directed conical spray of powder entrained in air. Attached to the cylindrical lower portion 14 of the mixing vessel 2 and depending therefrom is a flexible cylindrical connection 22 surrounding an outlet duct 25, the connection 24 is attached at its lower edge to an inlet duct 26 of a vibratory fluidised bed chamber 28.

The vibratory fluidised bed chamber 28 has four rectangular walls connected together at adjacent edges, a rectangular roof 30 including the inlet duct 26, a rectangular base 32 and an outlet duct 34 communicating with one of the rectangular walls remote from the inlet duct 26. Attached to the walls and positioned intermediate the roof 30 and base 32 of the fluidised bed chamber 28 is a diffuser plate 36 which divides the fluidised bed chamber 28 into an upper and a lower region (38,40). Attached to the base 32 of the fluidised bed chamber 28 and positioned intermediate the inlet duct 26 and the outlet duct 34 is an upright partition 42 which divides the lower region 40 of the fluidised bed chamber 28 into two discrete zones 39, 41. Fluidising air is directed from the lower region 40 through the diffuser plate 36 into the upper region 38 of the fluidised bed. The fluidising air is directed into each of the discrete zones 39, 41 separately through piping and ducting (not shown) which includes a pair of fans one of which has associated therewith a heater so that the fluidising air directed into the zone 39 adjacent the inlet duct 26 may be heated with respect to the fluidising air directed into the zone 41 adjacent the outlet duct 34. Attached to an external surface of the base of the fluidised bed chamber 28 are leaf springs 44 mounted on a base support 46. The fluidised bed chamber is vibrated on the springs by a motor 48 attached to the base support 46.

Communicating with the upper region 38 of the fluidised bed chamber 28 is a filter system (not shown) including cyclone filters which extract dust and any other extraneous matter from the fluidising air emanating from the fluidised bed chamber 28 and the entraining air before discharge to the atmosphere.

In operation powder particles having an average particle size in the range of 1 micron to 1.0 mm is charged into the screw feeder and then fed at a throughput rate in the range of 20 to 100 kg/hour of powder through the outlet duct 20 into the inlet duct 6 of the mixing vessel 2 to the mouth of the venturi device 22 as a free falling stream of powder. Simultaneously compressed air at a pressure in the range of 0.3 bar to 5.0 bar is supplied to the venturi device 22 at a throughput rate in the range of 12 $m^3$/hour to 30 $m^3$/hour which produces by an induced venturi action on discharge through the gap an acceleration in the flow rate of the powder stream and atmospheric air drawn into the mouth of the venturi device and a spreading of the powder stream into a downwardly directed conical spray of powder entrained in air. Liquid is then supplied to the nozzle 18, for example, a 0.4 mm diameter hollow cone pressure nozzle, at a maximum throughput rate of 22 liters/hour to produce a downwardly directed conical spray of liquid droplets which intermingle with the downwardly directed conical spray of powder entrained in air in the spray zone to produce a mixture of liquid droplets and partially coated powder particles in which 5 to 70% by weight of the mixture may be liquid. With continued downward movement the partially coated powder particles mixed with liquid droplets and the entraining air pass through the outlet duct 25 which is surrounded by the flexible connection 24 attached to the lower cylindrical portion 14 of the mixing vessel 2 and enters the upper region 38 of the vibratory fluidised bed chamber 28. The vibratory movement of the fluidised bed chamber 28 is effected by actuation of the motor 48 and fluidising air is directed through the ducts and fans into the discrete zones 39,41 of the lower region 40 of the fluidised bed chamber. The fluidising air then passes through the diffuser plate 36 at rates to give velocities in the range of 0.2 m/s to 1.2 m/s to fluidise the partially coated powder particles mixed with liquid droplets. After a dwell time in the range of 2 to 5 minutes for a depth of bed including air in the range of 20 mm to 80 mm the vibrating motion of the fluidised bed chamber 28 causes the product powder to be conveyed to the outlet duct 34 through which it is discharged. Fluidising air and entraining air is discharged from the upper portion 38 of the fluidised bed chamber into the filter system for filtering, and after filtering is completed the filtered air is discharged to the atmosphere.

In a modification of the previously described process, when the liquid supplied to the nozzle 18 is water or an emulsion containing water and evaporation to produce the product powder is required then the fluidising air supplied to the zone 39 adjacent to the inlet 26 is heated to a maximum temperature of 140° C. by the heater to evaporate off the water. Additionally the fluidising air supplied to the zone 41 adjacent the outlet duct 34 may be at a relatively lower temperature such that the product powder may be cooled to aid friability before discharge through the outlet duct 34.

In a modification of the previously described apparatus a guide member (not shown) having an axially aligned inlet and outlet, and downwardly converging frusto conical walls are positioned axially beneath the throat of the venturi device 22 in the frusto conical region 12 of the mixing vessel 2 with the outlet of the guide member surrounding the nozzle 18. The guide member facilitates the concentrating and guiding of the powder stream entrained in air emanating from the venturi device 22 such that enhanced mixing of the powder stream with liquid from the nozzle 18 is achieved in the spray zone. The guide member is used especially when water at a relatively high throughput rate is sprayed onto the powder.

Although in preceeding paragraphs a fluidised bed chamber 28 has been used to collect and dry the product powder, other collection and drying systems may be employed, for example a moving belt of a conveyor which moving belt passes through a drying tunnel.

Further regarding the fluidised bed chamber 28 although in preceeding paragraphs the lower region 40 has been described as being divided into two zones 39, 41, the lower region 40 may be divided into more than two separate zones each one of which may be supplied with heated, or cooled air depending on whether the air is to be used for evaporation of water or cooling of the product powder prior to discharge through the outlet duct 34.

Suitable powders and liquids which may be employed in the process described in preceeding paragraphs include spraying casein powder with an alkaline solution; spraying starch or starch derivatives with an alkaline solution or water; spraying animal feed with molasses and fats; spraying milk powder with fat or oil-in-water emulsions; spraying dried powders with water or other liquids to effect agglomeration; and spraying inorganic powders with solutions of detergent.

We claim:

1. A process for spraying a powder with liquid comprising introducing a continuous stream of powder of a particle size in the range of 1 micron to 1.0 mm into an upper region of a mixing vessel at a throughput rate in the range of 20 to 100 Kg/hour, effecting entrainment of the powder stream in air within the mixing vessel, by use of a venturi device positioned within the mixing vessel, contacting the powder stream entrained in air with liquid droplets discharging from a spray nozzle positioned in a spray zone located within the mixing vessel to form sprayed powder comprising powder particles conjoined with liquid droplets, collecting the sprayed powder in a vibratory fluidized bed chamber communicating with the mixing vessel, supplying the vibratory fluidized bed chamber with fluidizing air to give fluidizing velocities in the range of 0.2 m/s to 1.2 m/s and a fluidized bed depth in the range of 20 mm to 80 mm to produce a product powder after an average dwell time of the sprayed powder in the bed chamber of 2 to 5 minutes, and discharging the product powder as a continuous flow from the fluidized bed.

2. A process as claimed in claim 1, in which the effecting of entrainment of the powder stream in air is carried out using air having a super-atmospheric pressure in the range of 0.3 bar to 5.0 bar supplied at a throughput rate in the range of 12$m^3$ /hour to 30 $m^3$/hour.

3. A process as claimed in claim 2, in which the contacting of the powder entrained in air with liquid droplets in the spray zone is carried out at a liquid throughput rate not exceeding 22 liters/hour.

4. A process as claimed in claim 1, in which the powder stream entrained in air is guided and concentrated towards the spray zone.

5. A process as claimed in claim 1, in which the powder introduced as a continuous stream into the upper region of the mixing vessel is a casein, and the powder is contacted with liquid droplets in the form of an alkaline solution in the spray zone.

6. A process as claimed in claim 1, in which the powder introduced as a continuous stream into the upper region of the mixing vessel is one of a group comprising starch and starch derivatives, and the powder is contacted with one of a group of liquids comprising alkaline solutions and water in the spray zone.

7. A process as claimed in claim 1, in which the powder introduced as a continuous stream into the upper region of the mixing vessel is animal feed, and the powder is contacted with one of a group of liquids comprising molasses and fats in the spray zone to form an enriched animal feed.

8. A process as claimed in claim 1, in which the powder introduced as a continuous stream into the upper region of the mixing vessel is milk powder, and the powder is contacted with one of a group of liquids comprising fat and an oil-in-water emulsion in the spray zone.

9. A process as claimed in claim 1, in which the powder introduced as a continuous stream into the upper region of the mixing vessel is a dried powder, and the powder is contacted with a liquid in the spray zone to effect agglomeration.

10. A process as claimed in claim 1, in which the powder introduced as a continuous stream into the upper region of the mixing vessel is an inorganic substance, and the powder is contacted with detergent solution in the spray zone.

11. An apparatus for spraying a powder with liquid the apparatus comprising a mixing vessel having walls which form an axially aligned upper and a lower portion the upper portion including an inlet duct and the lower portion including an outlet duct, located within the walls of the mixing vessel intermediate the upper and lower portions is a spray zone, a feeing means is provided for feeding a continuous stream of powder into the inlet duct of the upper portion, the feeding means having an outlet duct axially aligned with the inlet duct and with the spray zone, a venturi device is axially positioned within the upper portion to effect entrainment of the powder stream in air, a spray nozzle is axially aligned within the spray zone to direct a spray of liquid into the powder stream entrained in air to form sprayed powder, and a vibratory fluidized bed chamber communicates with the outlet duct of the lower portion to facilitate collecting of the sprayed powder produced in the mixing vessel, and to facilitate discharge of a product powder.

12. An apparatus as claimed in claim 11, in which the vibratory fluidized bed chamber is provided with a plurality of discrete zones into which fluidizing air is fed.

13. An apparatus as claimed in claim 12, in which heaters are provided to heat the fluidizing air entering into selected ones of the discrete zones for effecting evaporation of liquid from the sprayed powder within the fluidized bed chamber so that a dried product powder is obtained.

14. An apparatus as claimed in claim 12, in which cooling means are provided to cool the fluidizing air entering into selected ones of the discrete zones for effecting cooling of the sprayed powder within the fluidizing bed chamber so that a friable product powder is obtained.

15. An apparatus as claimed in claim 11, in which the vibratory fluidized bed chamber includes a resilient means and a support which resilient means are actuated by a motor to effect vibratory motion of the fluidized bed chamber.

16. An apparatus as claimed in claim 11, in which the venturi device comprises an inlet, a circumferentially extending chamber which discharges through a gap extending circumferentially of a throat, and an outlet, the throat conveying compressed air to effect an acceleration in the flow rate of the powder stream entering the inlet and entrainment of the powder stream in air.

17. An apparatus as claimed in claim 16, in which a guide member is positioned axially beneath the venturi device and surrounding the spray nozzle to guide the powder stream entrained in air emanating from the venturi device into the spray zone.

* * * * *